US006478091B1

(12) United States Patent
Gano

(10) Patent No.: US 6,478,091 B1
(45) Date of Patent: Nov. 12, 2002

(54) EXPANDABLE LINER AND ASSOCIATED METHODS OF REGULATING FLUID FLOW IN A WELL

(75) Inventor: John C. Gano, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/565,000

(22) Filed: May 4, 2000

(51) Int. Cl.[7] ..... E21B 43/12; E21B 43/14; E21B 34/06

(52) U.S. Cl. ..... 166/373; 166/207; 166/316; 166/320; 166/386; 166/369; 166/313

(58) Field of Search ..... 166/373, 386, 166/277, 320, 227, 313, 316, 207, 65.1, 105, 106, 369

(56) References Cited

U.S. PATENT DOCUMENTS

| | | | | |
|---|---|---|---|---|
| 1,880,218 A | | 10/1932 | Simmons | |
| 3,028,915 A | | 4/1962 | Jennings | |
| 3,167,122 A | | 1/1965 | Lang | |
| 3,179,168 A | | 4/1965 | Vincent | |
| 3,203,451 A | | 8/1965 | Vincent | |
| 3,203,483 A | | 8/1965 | Vincent | |
| 3,297,092 A | | 1/1967 | Jennings | |
| 3,353,599 A | * | 11/1967 | Swift | 166/207 |
| 3,477,506 A | | 11/1969 | Malone | |
| 3,625,892 A | * | 12/1971 | Watanabe | 166/308 |
| 3,721,297 A | * | 3/1973 | Challacombe | 166/299 |
| 3,734,179 A | * | 5/1973 | Smedley | 166/106 |
| 3,899,631 A | * | 8/1975 | Clark | 174/47 |
| 4,671,352 A | * | 6/1987 | Magee, Jr. et al. | 166/186 |
| 5,083,608 A | | 1/1992 | Abdrakhmanov et al. | |
| 5,183,115 A | * | 2/1993 | Gano | 166/319 |
| 5,348,095 A | | 9/1994 | Worrall et al. | |
| 5,388,648 A | | 2/1995 | Jordan, Jr. | |
| 5,425,559 A | | 6/1995 | Nobileau | |
| 5,667,011 A | | 9/1997 | Gill et al. | |
| 5,695,008 A | | 12/1997 | Bertet et al. | |
| 5,718,288 A | | 2/1998 | Bertet et al. | |
| 5,794,702 A | | 8/1998 | Nobileau | |
| 5,892,860 A | * | 4/1999 | Maron et al. | 385/12 |
| 6,012,522 A | | 1/2000 | Donnelly et al. | |
| 6,012,523 A | | 1/2000 | Campbell et al. | |
| 6,021,850 A | | 2/2000 | Wood et al. | |
| 6,029,748 A | | 2/2000 | Forsyth et al. | |
| 6,044,906 A | | 4/2000 | Saltel | |
| 6,173,788 B1 | * | 1/2001 | Lembcke et al. | 166/387 |
| 6,273,195 B1 | * | 8/2001 | Hauck et al. | 166/374 |
| 6,298,917 B1 | * | 10/2001 | Kobylinski et al. | 166/369 |

FOREIGN PATENT DOCUMENTS

| | | |
|---|---|---|
| EP | 0643794 B1 | 11/1996 |
| EP | 0643795 B1 | 11/1996 |
| EP | 0795679 A2 | 9/1997 |
| WO | WO 93/25799 | 12/1993 |
| WO | WO 97/17526 | 5/1997 |
| WO | WO 97/17527 | 5/1997 |
| WO | WO 99/13195 | 3/1999 |

OTHER PUBLICATIONS

Weatherford Completion Systems, Expandable Sand Screen, Technical Data Sheet; Undated.

Petroline Well Systems, EST–Expandable Slotted Tube Products; Undated.

Enventure, Expandable–Tubular Technology; dated 1998.

* cited by examiner

*Primary Examiner*—Hoang Dang
(74) *Attorney, Agent, or Firm*—William M. Imwalle; Marlin R. Smith

(57) ABSTRACT

A method of regulating flow through a first tubular structure in a well provides flow control by use of an expandable second tubular structure inserted into the first tubular structure and deformed therein. In a described embodiment, a liner has sealing material externally disposed thereon. Expansion of the liner within a screen assembly may be used to sealingly engage the liner with one or more well screens of the screen assembly, and may be used to regulate a rate of fluid flow through one or more of the well screens.

70 Claims, 13 Drawing Sheets

EXPANDABLE LINER AND ASSOCIATED METHODS OF REGULATING FLUID FLOW IN A WELL

BACKGROUND OF THE INVENTION

The present invention relates generally to operations performed in conjunction with a subterranean well and, in an embodiment described herein, more particularly provides an expandable liner and associated methods of regulating flow through tubular structures in a well.

A wellbore may intersect multiple formations or zones from which it is desired to produce fluids. It is common practice to utilize well screens and gravel packing where the formations or zones are unconsolidated or poorly consolidated, in order to prevent collapse of the wellbore or production of formation sand. Thus, fluid production from one zone may flow through one well screen while production from another zone may pass through another well screen.

It is frequently desirable to be able to individually control the rate of production from different zones. For example, water encroachment or gas coning may prompt a reduction or cessation of production from a particular zone, while production continues from other zones.

Conventional practice has been to use a valve, such as a sliding sleeve-type valve, or a downhole choke to regulate fluid flow from a particular zone. However, where well screens are also utilized, it is often impractical, costly and inconvenient to use conventional valves or chokes to regulate fluid flow through the screens. Therefore, it is an object of the present invention to provide an improved method of regulating fluid flow through well screens. It is a further object of the present invention to provide methods and apparatus for regulating fluid flow through various tubular structures in a well.

SUMMARY OF THE INVENTION

In carrying out the principles of the present invention, in accordance with an embodiment thereof, a specially configured expandable liner is utilized in regulating fluid flow through a tubular structure in a wellbore. The flow regulating systems and methods described herein also permit economical, convenient and accurate control of production through individual well screens and screen assemblies.

In one aspect of the present invention, a screen assembly including multiple well screens is installed in a wellbore. An expandable liner is then inserted into the screen assembly. The liner is expanded by any of various methods (e.g., inflation, swaging, etc.), so that the liner is sealingly engaged with the interior of the screen assembly. For example, the liner may be sealingly engaged straddling a well screen, so that fluid flow through the well screen must also pass through an opening formed through a sidewall of the liner.

Expansion of the liner may also be used to control the rate of fluid flow through the screen assembly. For this purpose, a sealing material may be disposed externally on the liner between an inflow area of a well screen and the opening formed through the liner sidewall. By squeezing the sealing material between the liner and the screen assembly, a flow area formed between portions of the sealing material is reduced.

By retracting the liner inwardly away from the screen assembly, the flow area may also be increased, thereby increasing the rate of fluid flow through the well screen. Thus, the flow rate through the screen may be increased or decreased as desired by retracting or expanding the liner within the screen assembly.

The exterior of the liner which contacts the interior of the screen assembly may be configured to provide further regulation of fluid flow. For example, the sealing material may have one or more channels formed therein or therethrough. The channels may be tortuous to provide flow choking. Plugs may be provided to reduce the number of channels through which fluid may flow.

Tools for expanding and retracting the liner are also provided by the present invention. One such tool includes a sensor sensing a parameter, such as flow rate, temperature, pressure, etc., of the fluid flowing through a well screen. This permits the effect of expansion or retraction of the liner to be evaluated downhole for an individual well screen, or for multiple screens.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Representatively illustrated in FIGS. 1A–E is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

Figure 1A:
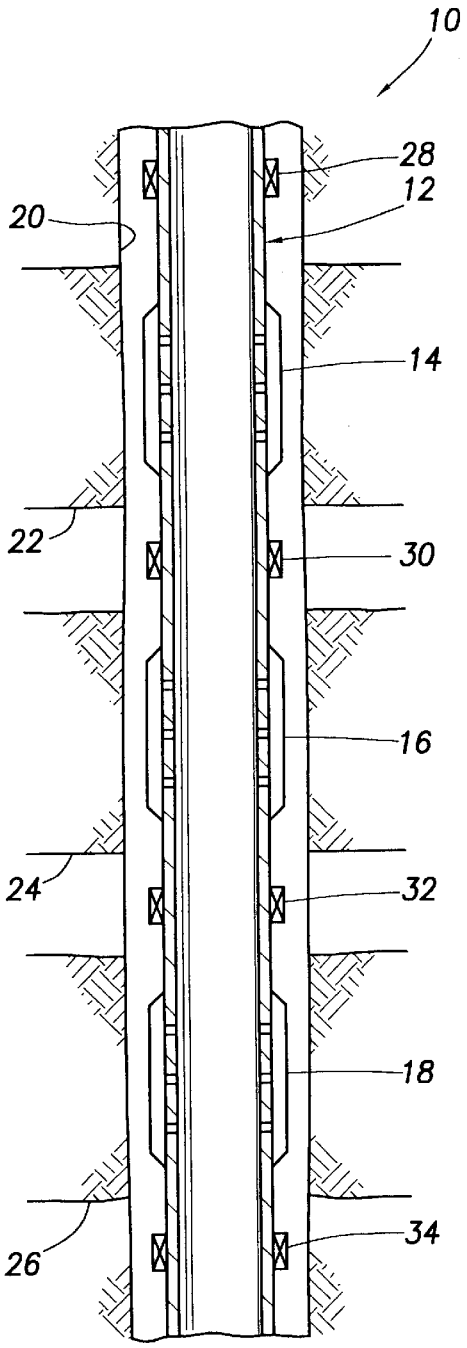
FIGS. 1A–E are schematic views of successive steps in a method of regulating flow through well screens, the method embodying principles of the present invention.

Referring initially to FIG. 1A, in the method 10, a screen assembly 12 including multiple well screens 14, 16, 18 is conveyed into a wellbore 20. The wellbore 20 intersects multiple formations or zones 22, 24, 26 from which it is desired to produce fluids. The screens 14, 16, 18 are positioned opposite respective ones of the zones 22, 24, 26.

The wellbore 20 is depicted in FIGS. 1A–E as being uncased, but it is to be clearly understood that the principles of the present invention may also be practiced in cased wellbores. Additionally, the screen assembly 12 is depicted as including three individual screens 14, 16, 18, with only one of the screens being positioned opposite each of the zones 22, 24, 26, but it is to be clearly understood that any number of screens may be used in the assembly, and any number of the screens may be positioned opposite any of the zones, without departing from the principles of the present invention. Thus, each of the screens 14, 16, 18 described herein and depicted in FIGS. 1A–E may represent multiple screens.

Sealing devices 28, 30, 32, 34 are interconnected in the screen assembly 12 between, and above and below, the screens 14, 16, 18. The sealing devices 28, 30, 32,34 could be packers, in which case the packers would be set in the wellbore 20 to isolate the zones 22, 24, 26 from each other in the wellbore. However, the sealing devices 28, 30, 32, 34 are preferably expandable sealing devices, which are expanded into sealing contact with the wellbore 20 when the screen assembly 12 is expanded as described in further detail below. For example, the sealing devices 28, 30, 32, 34 may include a sealing material, such as an elastomer, a resilient material, a nonelastomer, etc., externally applied to the screen assembly 12.

Figure 1B:
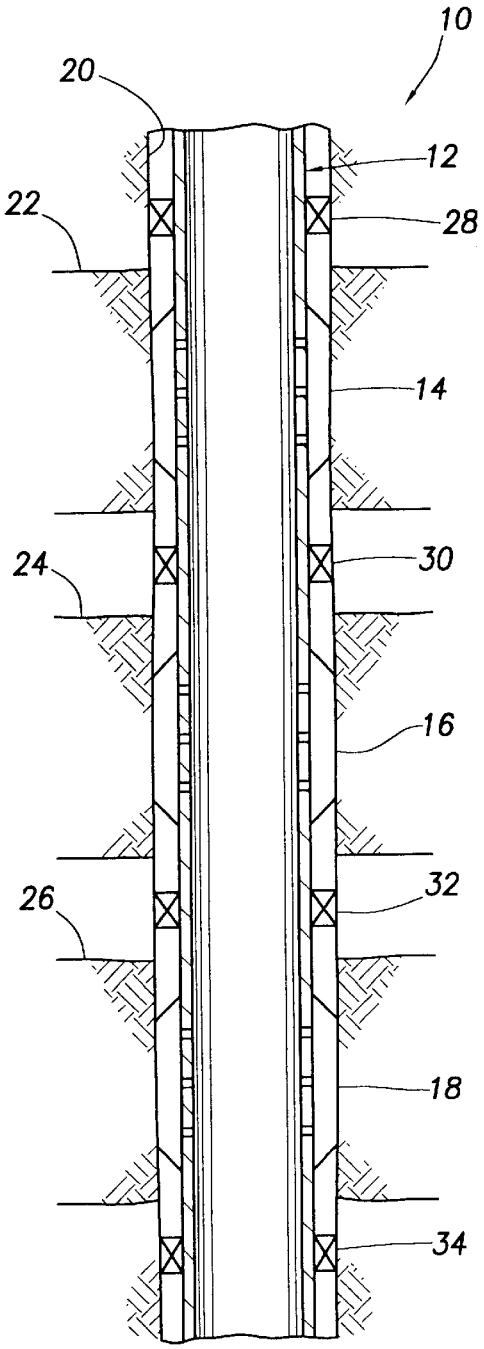

Referring additionally now to FIG. 1B, the screen assembly 12 has been expanded radially outward. The sealing devices 28, 30, 32 and 34 now sealingly engage the wellbore 20 between the screens 14, 16, 18, and above and below the screens.

Additionally, the screens 14, 16, 18 preferably contact the wellbore 20 at the zones 22, 24, 26. Such contact between the screens 14, 16, 18 and the wellbore 20 may aid in preventing formation sand from being produced. However, this contact is not necessary in keeping with the principles of the present invention.

The use of an expandable screen assembly 12 has several benefits. For example, the radially reduced configuration shown in FIG. 1A may be advantageous for passing through a restriction uphole, and the radially expanded configuration shown in FIG. 1B may be advantageous for providing a large flow area and enhanced access therethrough. However, the use of an expandable screen assembly is not required in keeping with the principles of the present invention.

Figure 1C:
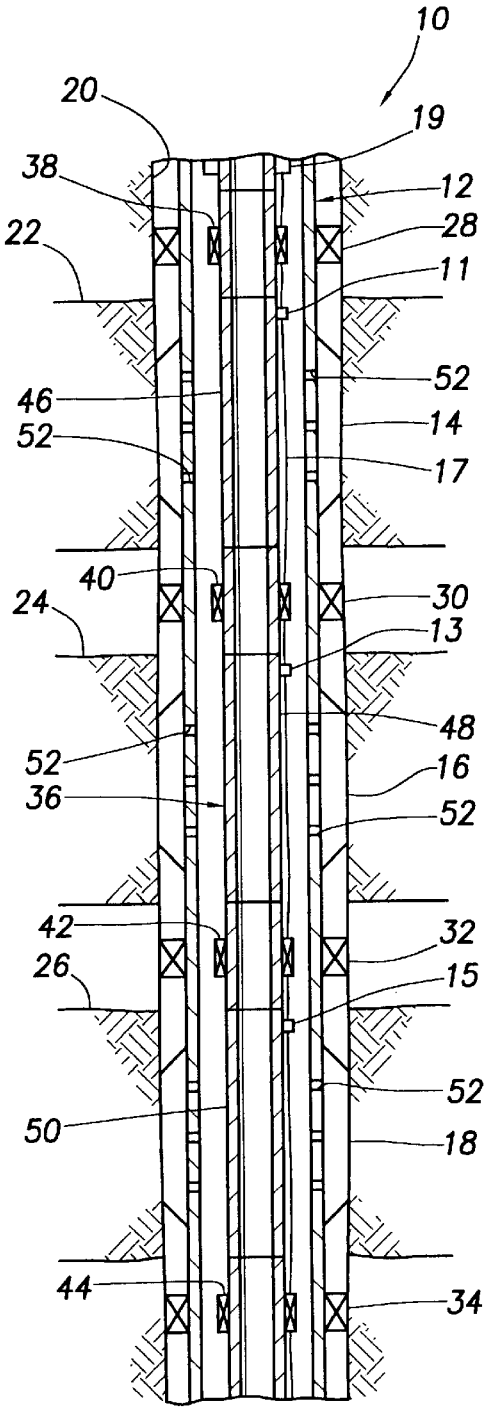

Referring additionally now to FIG. 1C, an expandable tubular structure or liner assembly 36 is received within the screen assembly 12. The liner assembly 36 includes sealing devices 38, 40, 42, 44 straddling flow control devices 46, 48, 50. Note that the sealing devices 38, 40, 42, 44 are similar to the sealing devices 28, 30, 32, 34 in that they are radially expandable, but they may alternatively be conventional devices, such as packers, etc.

The flow control devices 46, 48, 50 are shown schematically in FIG. 1C, and are described in further detail below. Each of the flow control devices 46, 48, 50 is used to regulate fluid flow through one of the screens 14, 16, 18. Production of the fluid to the surface is accomplished through the liner assembly 36, and the fluid passes inwardly through an inflow area of each screen (typically, a series of openings 52 formed through a base pipe of each screen), thus, each of the flow control devices 46, 48, 50 regulates fluid flow between the inflow area of one of the screens 14, 16, 18 and the interior of the liner assembly.

A series of sensors 11, 13, 15 is carried externally on the liner assembly 36. The sensors 11, 13, 15 may be any type of sensors, such as, temperature sensors, pressure sensors, water cut sensors, flowmeters, etc., or any combination of sensors. The sensors 11, 13, 15 are interconnected by one or more lines 17, which are preferably fiber optic, but which may be any type of line, such as hydraulic, electrical conductor, etc.

If the lines 17 are fiber optic, then the lines may extend to the earth's surface, or they may terminate at a downhole junction 19. The junction 19 may be a converter and may transform an optical signal on the lines 17 to an electrical signal for transmission to a remote location. Alternatively, the junction 19 may be an item of equipment known to those skilled in the art as a wet connect or inductive coupling, whereby a tool (not shown) conveyed on wireline or another conveyance may be placed in communication with the sensors 11, 13, 15, via the lines 17. As another alternative, the lines 17 may enter the interior of the liner assembly 36 at the junction 19, and extend uphole through the liner assembly to a remote location.

If the lines 17 are fiber optic, then the lines themselves may be used to sense temperature downhole. It is well known that light passing through a fiber optic line or cable is changed in a manner indicative of the temperature of the fiber optic line.

Figure 1D:
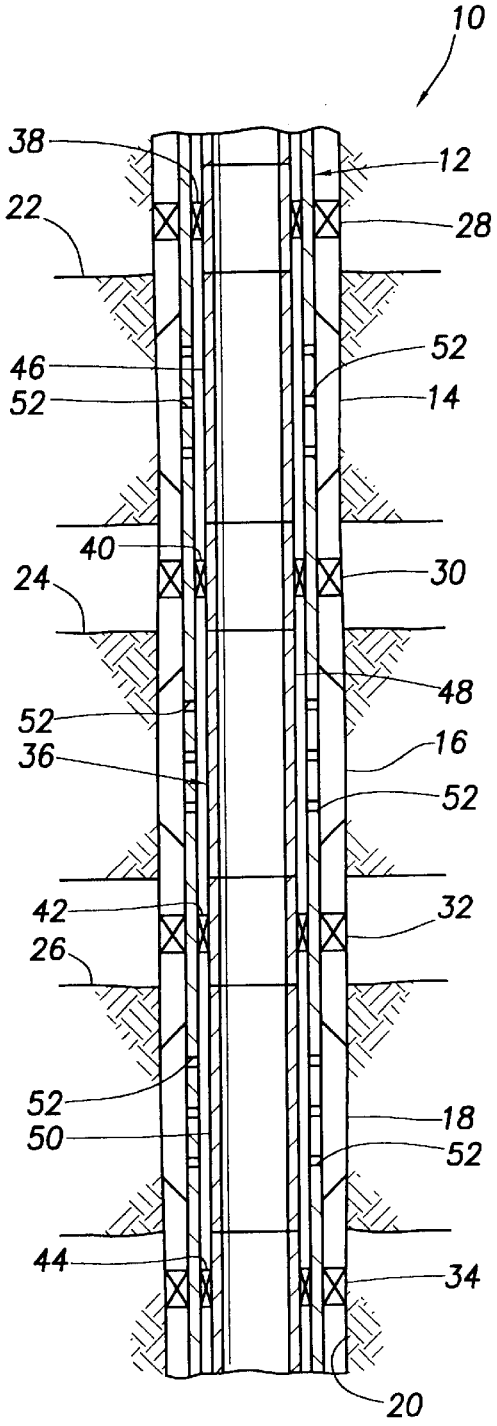

Referring additionally now to FIG. 1D, the liner assembly 36 has been expanded radially outward, so that the sealing devices 38, 40, 42, 44 are in sealing contact with the interior of the screen assembly 12. The sealing devices 38, 40 straddle the screen 14, thereby constraining fluid flow through the screen 14 to also flow through the flow control device 46.

The sealing devices 40, 42 straddle the screen 16, thereby constraining fluid flow through the screen 16 to also flow through the flow control device 48. The sealing devices 42, 44 straddle the screen 18, thereby constraining fluid flow through the screen 18 to also flow through the flow control device 50.

Note that the sensors 11, 13, 15, lines 17 and junction 19 are not shown in FIG. 1D.

Figure 1E:
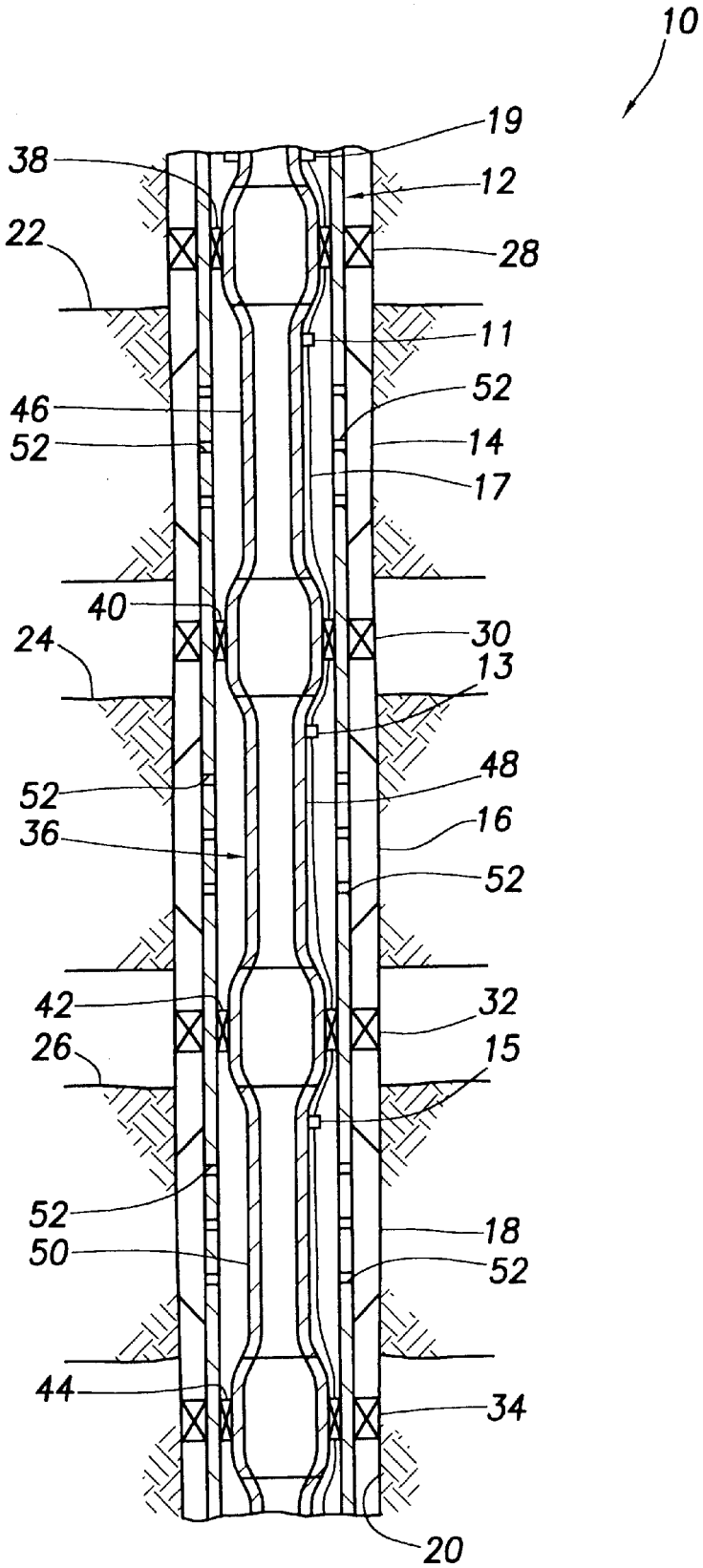

Referring additionally to FIG. 1E, an alternate configuration of the liner assembly 36 is depicted, in which only portions of the liner assembly have been radially expanded. In this case, the sealing devices 38, 40, 42, 44 have been expanded into sealing contact with the screen assembly 12.

Figure 3A:
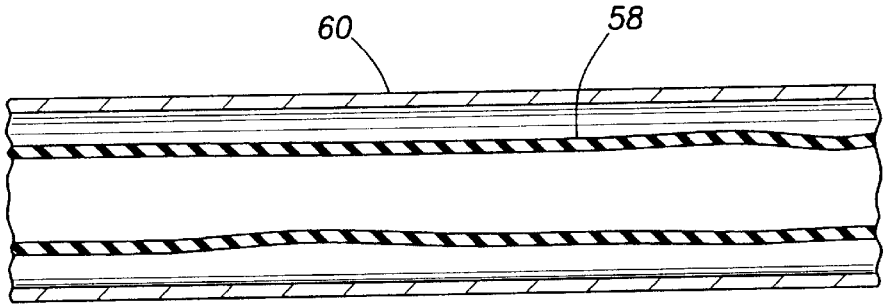
FIGS. 3A&B are enlarged scale schematic views of a second method of expanding a tubular structure in the method of FIG. 1.

This result may be accomplished by utilizing a tool (described below) which is capable of individually expanding portions of the liner assembly 36. Alternatively, selected portions of the liner assembly 36 which are desired to be expanded may be made less resistant to expansion than the remainder of the liner assembly. For example, the sealing devices 38, 40, 42, 44 may have a thinner cross-section, may be made of a more readily expandable material, may be initially configured at a larger radius, thereby producing greater hoop stresses, etc. In this manner, an inflation pressure may be applied to the liner assembly 36 and the portions less resistant to expansion will expand at a rate greater than the remainder of the liner assembly. A tool for applying an inflation pressure to the liner assembly 36 is shown in FIGS. 3A&B and is described below, but it should be understood that such an inflation pressure could also be applied directly to the liner assembly, for example, at the surface.

Expansion of selected portions of the liner assembly 36 may also be used to regulate fluid flow through the screens 14, 16, 18. For example, if the flow control devices 46, 48, 50 are made less resistant to radial expansion, so that flow regulating portions thereof (described in further detail below) are radially compressed when the inflation pressure is applied to the liner assembly 36, this compression of the flow regulating portions may be used to restrict fluid flow through the screens 14, 16, 18. The manner in which compression of a flow regulating portion of a flow control device may be used to alter a flowpath thereof and thereby regulate fluid flow therethrough is described below.

Note that the sensors 11, 13, 15 may now be used to individually measure characteristics of fluid flow between the respective zones 22, 24, 26 and the interior of the liner assembly 36. Of course, other parameters and characteristics may be sensed by the sensors 11, 13, 15, without departing from the principles of the present invention.

Figure 2:
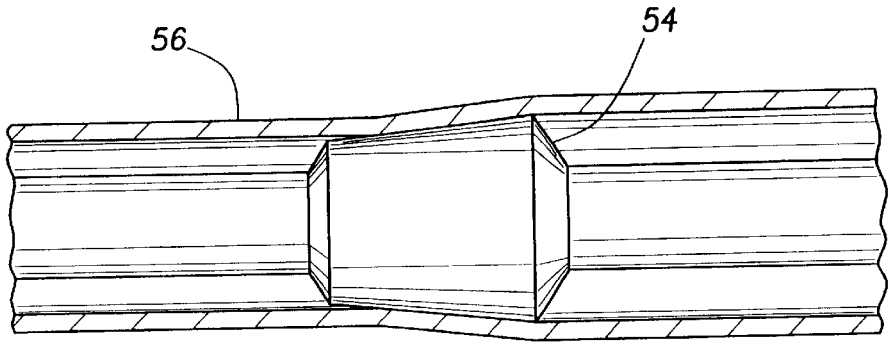
FIG. 2 is an enlarged scale schematic view of a first method of expanding a tubular structure in the method of FIG. 1.

Referring additionally now to FIG. 2, a swaging tool 54 is shown being displaced through a tubular structure 56. The tubular structure 56 may be the screen assembly 12 or the liner assembly 36 described above. As the swaging tool 54 is displaced through the tubular structure 56, the tubular structure is radially expanded.

Figure 3B:
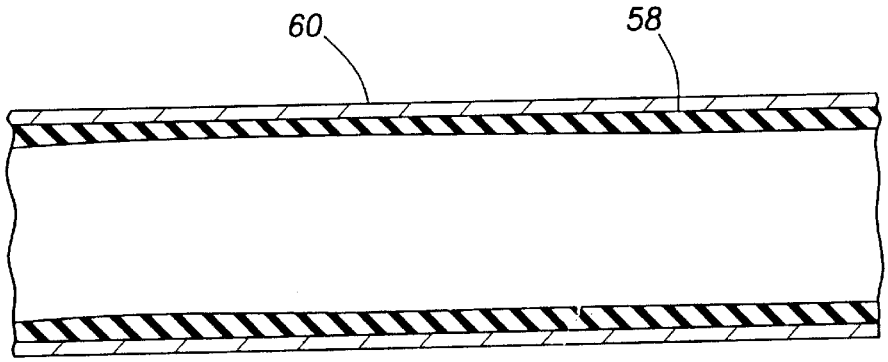

Referring additionally now to FIGS. 3A&B, a tubular membrane or inflation tool 58 is used to radially expand a tubular structure 60. The tubular structure 56 may be the screen assembly 12 or the liner assembly 36 described above. In FIG. 3A, the inflation tool 58 is received within the tubular structure 60, with the inflation tool being in a deflated configuration. In FIG. 3B, the inflation tool 58 has been inflated, for example, by applying a fluid pressure to the interior thereof, thereby causing the tubular structure to be expanded radially outward.

Figure 4:
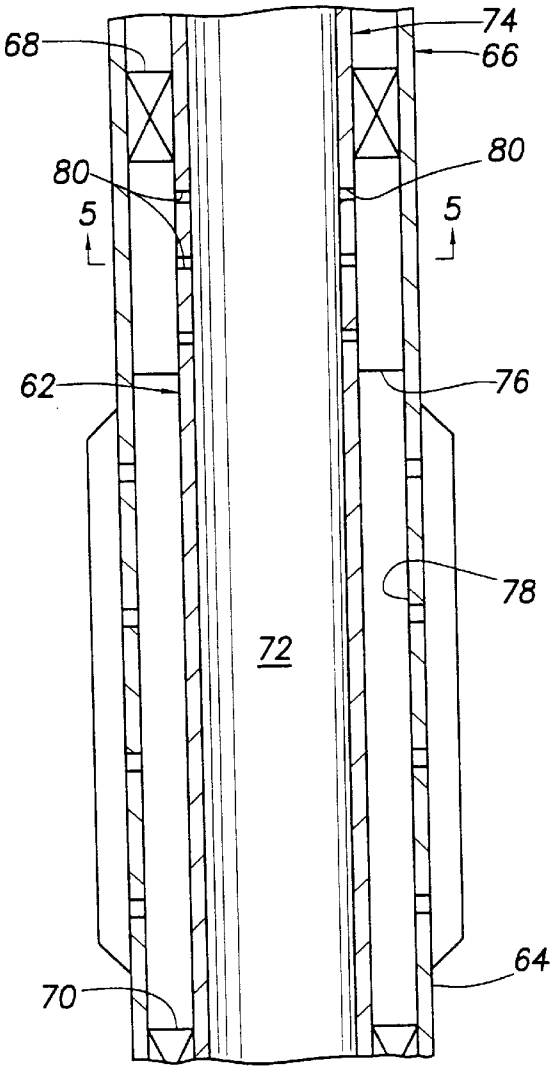
FIG. 4 is a schematic cross-sectional view of a first system for regulating flow through well screens, the system embodying principles of the present invention.

Referring additionally now to FIG. 4, a flow control device 62 embodying principles of the present invention is representatively illustrated. The flow control device 62 may be used for the flow control devices 46, 48, 50 in the method 10, or it may be used in other methods. As depicted in FIG. 4, the flow control device 62 is positioned within a well screen 64 of a screen assembly 66. Sealing devices 68, 70 constrain fluid flowing inwardly through the screen 64 to also pass through the flow control device 62 before entering an internal axial flow passage 72 of a tubular structure 74 in which the flow control device is interconnected.

The flow control device 62 includes a flow regulating portion 76, which operates in response to a degree of compression thereof. Note that the flow regulating portion 76 is positioned radially between the tubular structure 74 and the screen assembly 66. When the tubular structure 74 is radially expanded, the flow regulating portion 76 is compressed between the tubular structure and the screen assembly 66. Conversely, when the tubular structure 74 is radially retracted, the flow regulating portion 76 is decompressed. This degree of compression of the flow regulating portion 76 is used to control the rate of fluid flow between the inflow area 78 of the screen 64 and openings 80 formed through a sidewall of the flow control device 62.

Figure 5A:
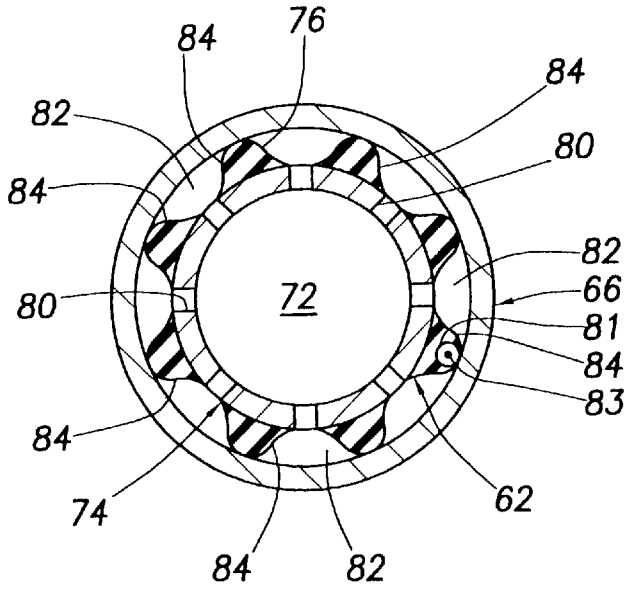
FIGS. 5A&B are schematic cross-sectional views of the system of FIG. 4, taken along line 5—5 of FIG. 4.

Referring additionally to FIGS. 5A&B, the manner in which the flow regulating portion 76 controls the rate of fluid flow therethrough is representatively illustrated. Note that the flow regulating portion 76 includes multiple longitudinal flowpaths or channels 82 formed between circumferentially distributed longitudinal strips 84 of sealing material.

In addition, the flow regulating portion 76 includes a semicircular longitudinal channel 81 in which lines 83 are received. The lines 83 may be similar to the lines 17 in the method 10 described above. In this manner, the lines 83 may be easily and conveniently attached to the exterior of the tubular structure 74 while it is being run into the well. That is, the lines 83 are snapped into the longitudinal channel 81 as the tubular structure 74 is lowered into the well.

As depicted in FIG. 5A, the tubular structure 74 has been radially expanded sufficiently for the strips 84 of sealing material to contact the interior of the screen assembly 66. Flow area for fluid flow between the screen inflow area 78 and the openings 80 is provided by the channels 82.

Figure 5B:
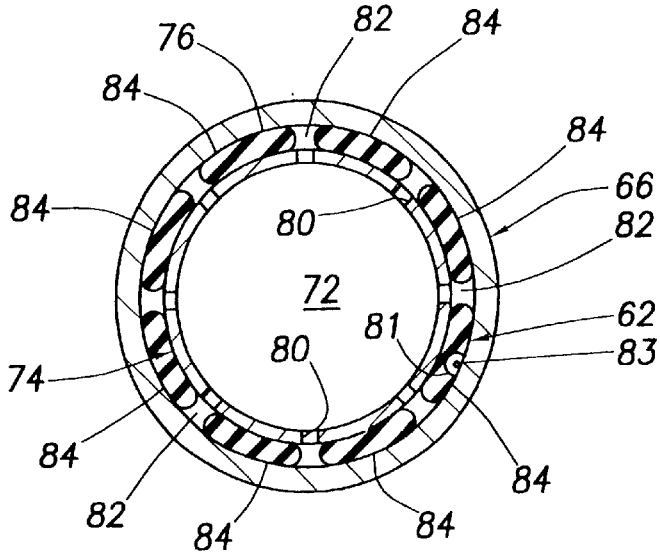

As depicted in FIG. 5B, the tubular structure 74 has been further radially expanded. The sealing material has been compressed between the tubular structure 74 and the screen assembly 66, so that the channels 82 are now reduced in height and width, thereby reducing the flow area therethrough. Still further expansion of the tubular structure 74 may completely close off the channels 82, thereby preventing fluid flow therethrough.

Note that the lines 83 remain in the channel 81 and do not affect, or only minimally affect, the amount of flow area through the channels 82. No fluid flow is permitted through the channel 81 due to the compression of the strip 84 of sealing material on which the channel is formed. As depicted in FIG. 5B, the lines 83 are compressed in the channel 81 between the sealing material and the screen assembly 66. Of course, the lines 83 could be sealingly installed in the channel 81 initially, if desired, in which case compression of the strip 84 of sealing material may not be used to seal the lines 83 in the channel 81.

Alternatively, the tubular structure 74 may be radially retracted from its configuration as shown in FIG. 5B to its configuration as shown in FIG. 5A. In this manner, restriction to fluid flow through the flow regulating portion 76 may be decreased if it is desired to increase the rate of fluid flow through the screen 64.

It will, thus, be readily appreciated that the flow control device 62 provides a convenient means of regulating fluid flow through the well screen 64. Expansion of the tubular structure 74 restricts, or ultimately prevents, fluid flow through the channels 82, and retraction of the tubular structure decreases the restriction to fluid flow through the channels, thereby increasing the rate of fluid flow through the screen 64.

Figure 6:
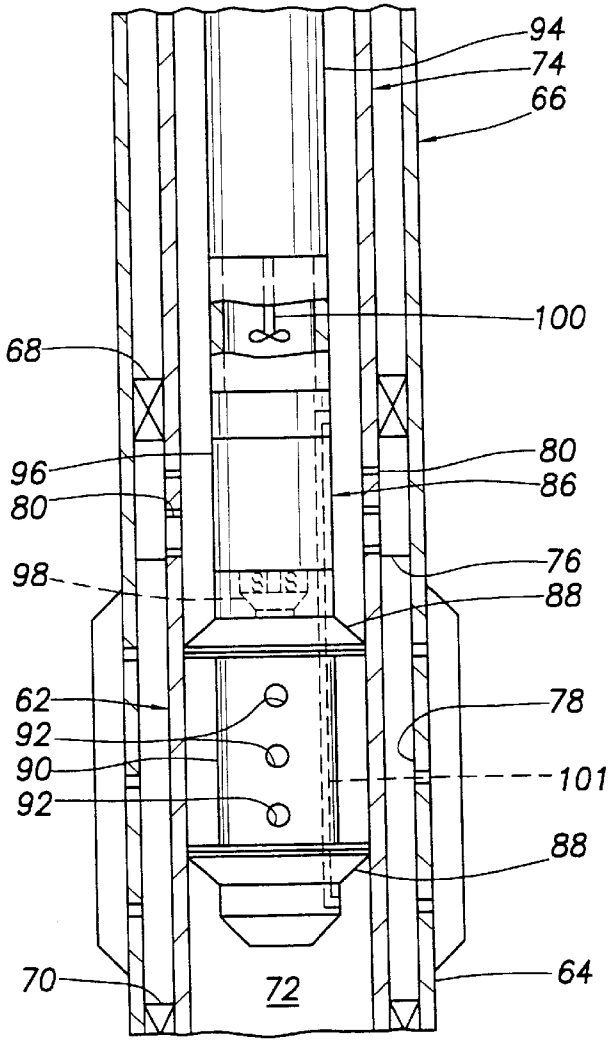
FIG. 6 is a schematic cross-sectional view of a first tool used to expand a liner, the tool embodying principles of the present invention.

Referring additionally now to FIG. 6, a tool 86 which may be used to expand selected portions of the tubular structure 74 is representatively illustrated received within the flow control device 62. The tool 86 may be used to expand the sealing devices 68, 70 into sealing contact with the screen assembly 66, may be used in the method 10 to expand portions of the liner assembly 36, etc.

The tool 86 includes a set of axially spaced apart seals 88, such as cup seals, and a tubular housing 90. The tool 86 may be conveyed on a coiled tubing string 94 or other type of tubular string. Pressure is applied to the tubing string 94 to cause an expansion portion 96 of the tool 86 to expand, thereby expanding a portion of the tubular structure 74 opposite the expansion portion of the tool. Note that it is not necessary for the tool 86 to be conveyed on the tubing string 94, since pressure for expansion of the tubular structure 74 may be delivered by a downhole pump conveyed on wireline, etc.

In conjunction with use of the tool 86 to expand portions of the tubular structure 74, the seals 88 and openings 92 in the housing 90 are used to monitor fluid flow through the screen 64. Specifically, when it is desired to monitor fluid flow through the screen 64, the seals 88 are positioned straddling the openings 80. Fluid flowing inwardly through the openings 80 between the seals 88 is thus constrained to flow inwardly through the openings 92 and into the tool 86.

The tool 86 includes a check valve or float valve 98 and a sensor 100. The check valve 98 prevents fluid pressure applied to the tool 86 to expand the expansion portion 96 from being transmitted through the openings 92 to the area between the seals 88. The sensor 100 is used to indicate a parameter of the fluid flowing through the tool 86. For example, the sensor 100 is schematically represented in FIG. 6 as a flowmeter, but it is to be clearly understood that the sensor may sense temperature, pressure, water cut, etc., or any other parameter of the fluid in addition to, or instead of, the flow rate.

In operation, the tool 86 is conveyed into the tubular structure 74 and positioned so that the expansion portion 96 is opposite the portion of the tubular structure to be expanded. As depicted in FIG. 6, the expansion portion 96 is positioned opposite the flow regulating portion 76 of the flow control device 62. Pressure is applied to the tubular string 94, causing the expansion portion 96 to expand radially outward, and thereby causing the expansion portion to contact and radially expand the tubular structure 74. As depicted in FIG. 6, radial expansion of the expansion portion 96 would cause radial compression of the flow regulating portion 76, thereby increasing the restriction to fluid flow therethrough.

The effectiveness of this operation may be verified by repositioning the tool 86 so that the seals 88 straddle the openings 80. Fluid flowing inwardly through the openings 80 will flow into the openings 92, and parameters, such as flow rate, may be measured by the sensor 100. If the flow rate is too high, the tool 86 may again be repositioned so that the expansion portion 96 is opposite the flow regulating portion 76 and the operation may be repeated until the desired flow rate is achieved. Note that a bypass passage 101 may be provided in the tool 86, so that production from the well below the flow control device 62 may be continued during the expansion and flow rate measuring operations.

It will be readily appreciated that the tool 86 provides a convenient and effective means for individually adjusting the rate of fluid flow through well screens downhole. This result is accomplished merely by conveying the tool 86 into the tubular structure 74, positioning it opposite the structure to be expanded, applying pressure to the tool, and repositioning the tool to verify that the flow rate is as desired. While the fluid flow rate is being adjusted and verified, the bypass passage 101 permits production from the well below the tool 86 to continue.

Figure 7:
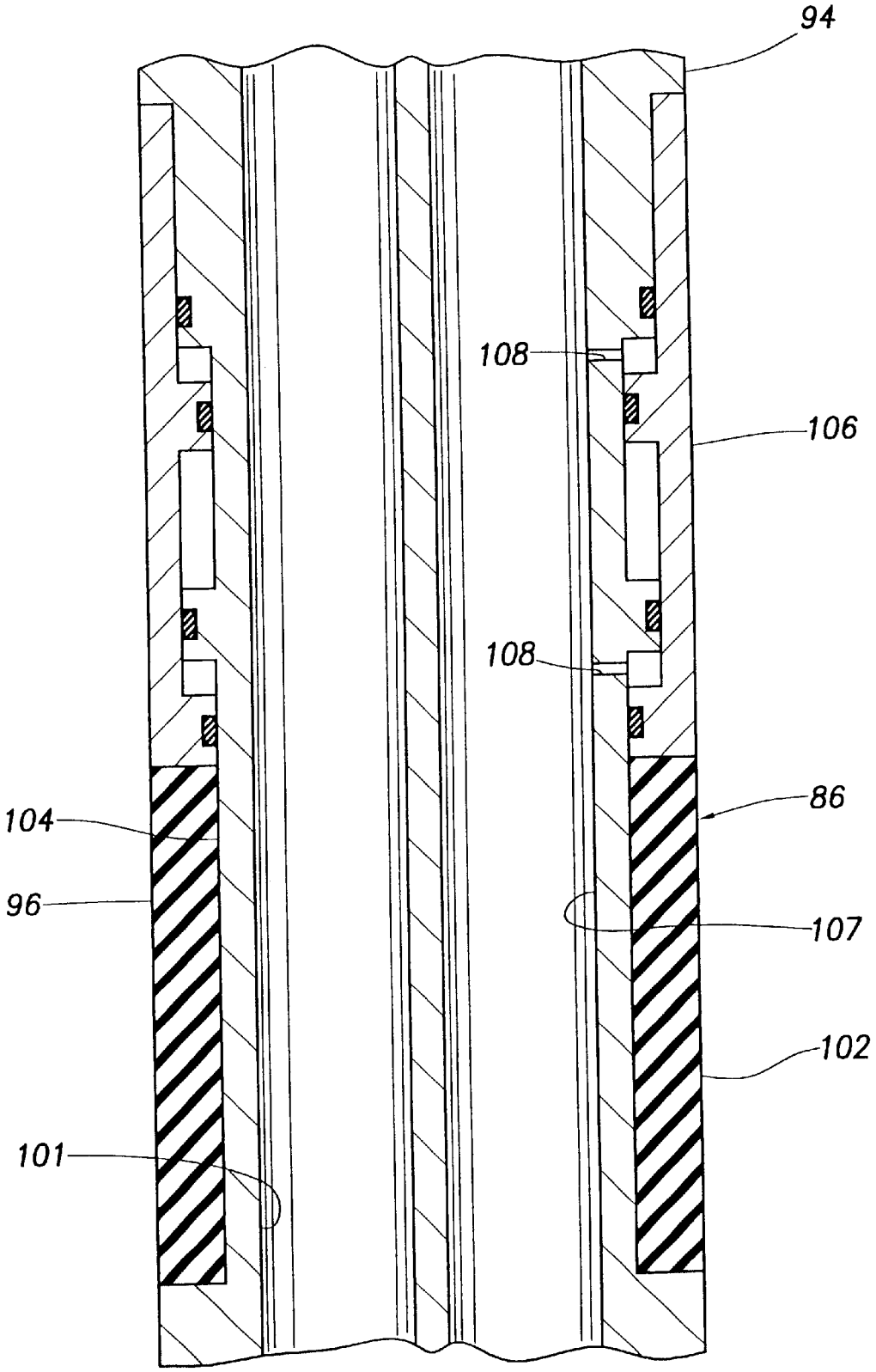
FIG. 7 is a schematic cross-sectional view of a second tool used to expand a liner, the tool embodying principles of the present invention.

Referring additionally now to FIG. 7, an enlarged scale cross-sectional view of the expansion portion 96 of the tool 86 is representatively illustrated. The expansion portion 96 includes an annular-shaped resilient member 102 carried on a generally tubular mandrel 104. A piston 106 is also carried on the mandrel 104.

The piston 106 is in fluid communication with an internal fluid passage 107 of the mandrel 104 by means of openings 108 formed through a sidewall of the mandrel. Pressure applied internally to the tubing string 94 is communicated to the passage 107 and is, thus, applied to the piston 106, biasing the piston downwardly and thereby axially compressing the member 102. When the member 102 is axially compressed, it also expands radially outward. Such radially outward expansion of the member 102 may be used to radially expand portions of the tubular structure 74 as described above.

Note that the tool 86 may be used to individually regulate fluid flow through multiple well screens. For example, in the method 10 as depicted in FIG. 1E, the tool 86 may be used to expand the flow control devices 46, 48, 50 so that a flow rate through the screen 18 is less than a flow rate through the screen 16, and the flow rate through the screen 16 is less than a flow rate through the screen 14. This result may be accomplished merely by using the tool 86 to expand a flow regulating portion of the flow control device 50 more than expansion of a flow regulating portion of the flow control device 48, and to expand the flow regulating portion of the flow control device 48 more than expansion of a flow regulating portion of the flow control device 46. Thus, the flow rate through each of the screens 14, 16, 18 may be individually controlled using the tool 86.

Figure 8:
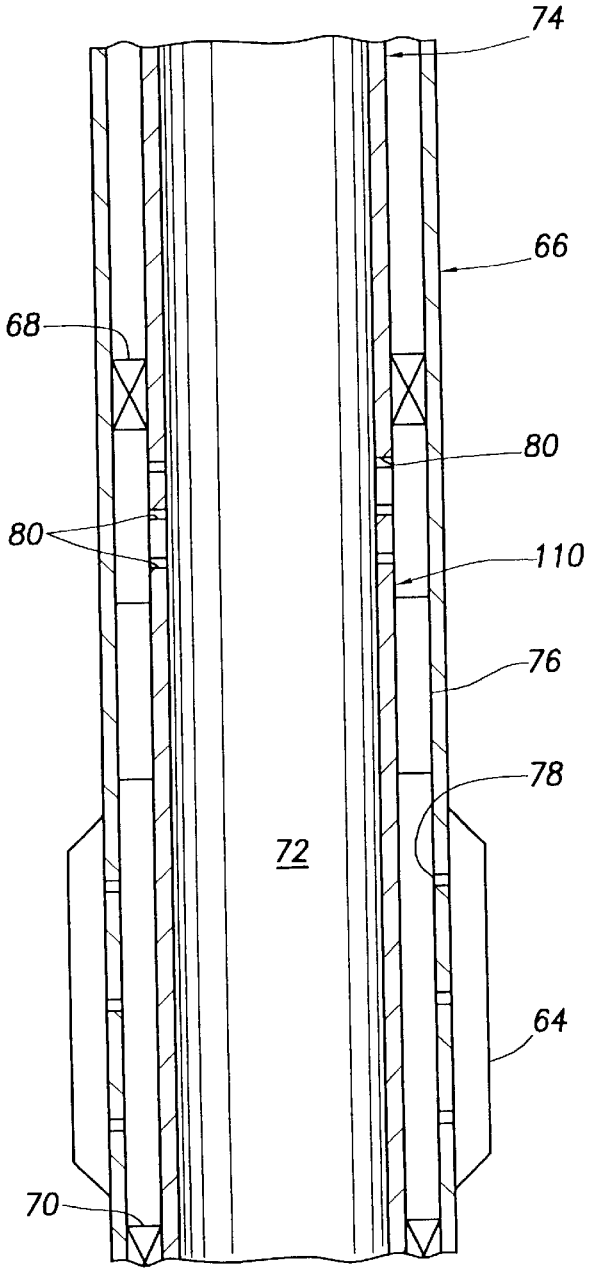
FIG. 8 is a schematic cross-sectional view of a second system for regulating flow through well screens, the system embodying principles of the present invention.

Referring additionally now to FIG. 8, an alternate configuration of a flow control device 110 embodying principles of the present invention is representatively illustrated. The flow control device 110 is similar in many respects to the flow control device 62 described above, and it is depicted in FIG. 8 received within the screen assembly 66 shown in FIG. 4. Portions of the flow control device 110 which are similar to those of the flow control device 62 are indicated in FIG. 8 using the same reference numbers.

The flow control device 110 differs from the flow control device 62 in part in that the flow control device 110 has the openings 80 axially separated from the flow regulating portion 76. Thus, as viewed in FIGS. 5A&B, the openings 80 of the flow control device 110 are not located at the bottoms of the channels 82 but are instead positioned between the flow regulating portion 76 and the sealing device 68.

Figure 9:
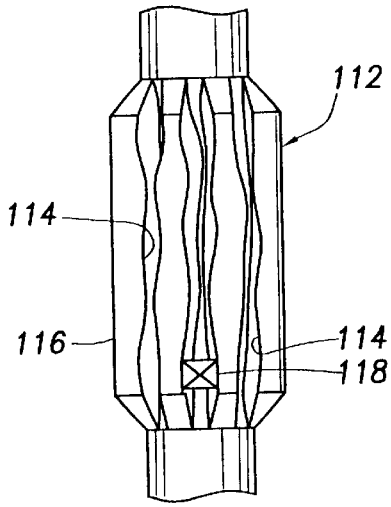
FIG. 9 is a schematic elevational view of a first expandable liner embodying principles of the present invention.

Referring additionally now to FIG. 9, a flow regulating portion 112 which may be used for the flow regulating portion 76 in the flow control device 62 or 110 is representatively illustrated. The flow regulating portion 112 includes channels 114 formed thereon in sealing material 116. The channels 114 undulate, so that they are at some points more restrictive to fluid flow therethrough than at other points. This channel configuration may provide a desired restriction to flow through the flow regulating portion 112 when the material 116 is radially compressed.

A plug 118 may be installed in one or more of the channels 114 to further restrict fluid flow through the flow regulating portion 112. In this manner, the flow regulating portion 112 may be set up before it is installed, based on information about the particular zone from which fluid will be produced through the flow regulating portion, to provide a desired range of flow restriction. This is readily accomplished by selecting a number of the channels 114 in which to install the plugs 118.

Figure 10:
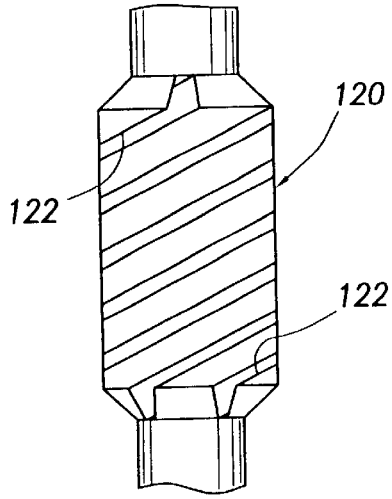
FIG. 10 is a schematic elevational view of a second expandable liner embodying principles of the present invention.

Referring additionally now to FIG. 10, another alternate configuration of a flow regulating portion 120 is representatively illustrated. The flow regulating portion 120 has channels 122 formed thereon, which follow tortuous paths across the flow regulating portion. The tortuous shape of the channels 122 provides restriction to fluid flow through the channels. One or more of the channels 122 may be plugged, if desired, to provide further restriction to flow, for example, by using one or more of the plugs 118 as described above.

The channels 122, 114, 82 have been described above as if they are formed with an open side facing outwardly on the flow regulating portions 76, 112, 120. However, it is to be clearly understood that the channels 122, 114, 82 may be otherwise-shaped and may be differently positioned on the flow regulating portions 76, 112, 120, without departing from the principles of the present invention. For example, the channels 122, 114, 82 could be formed internally in the flow regulating portions 76, 112, 120, the channels could have circular crosssections, etc.

Figure 11A:
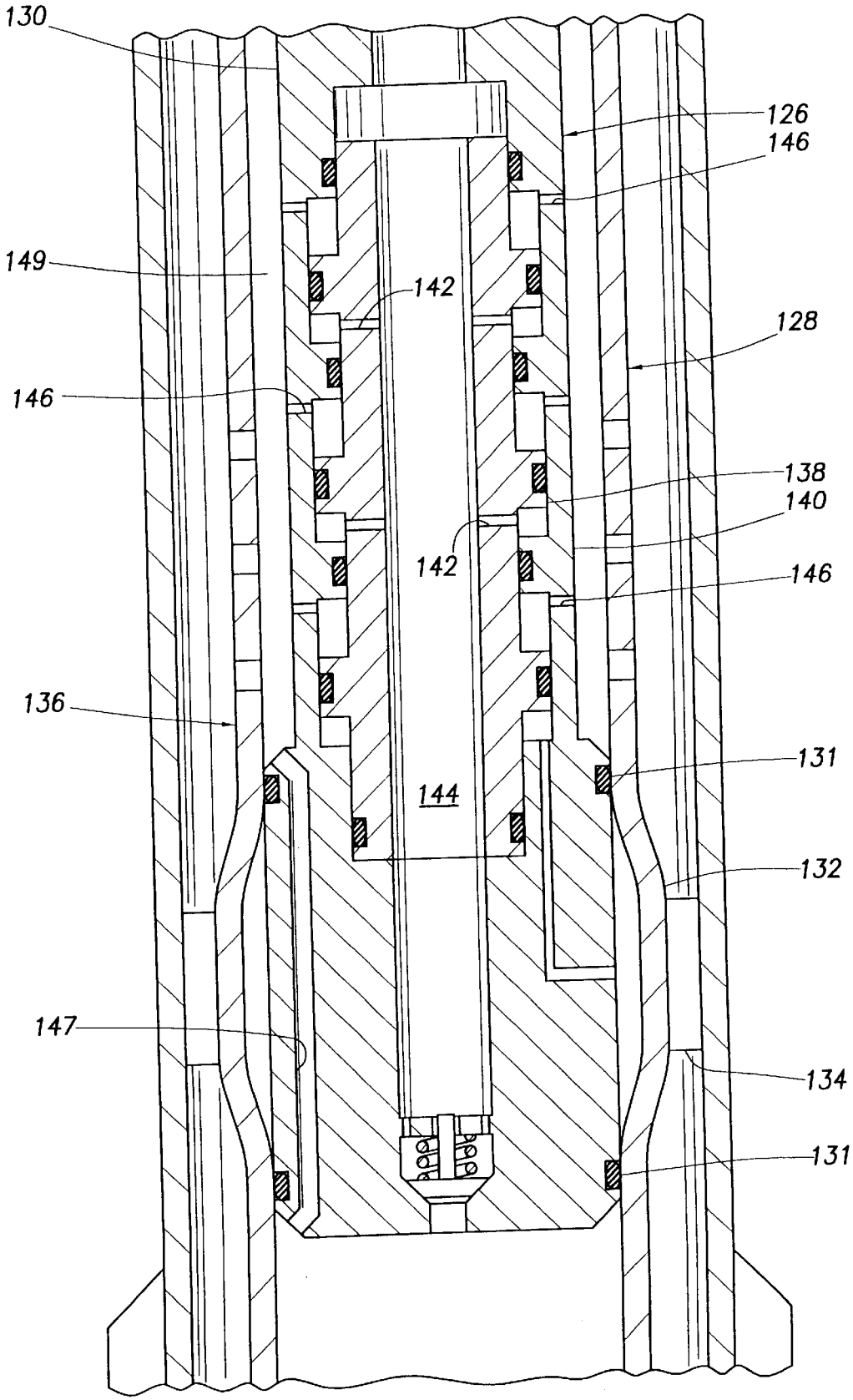
FIGS. 11A&B are schematic cross-sectional views of a tool for retracting a liner, the tool embodying principles of the present invention.

Referring additionally now to FIGS. 11A&B, a tool 126 used to radially retract portions of a tubular structure 128 is representatively illustrated. The tool 126 is preferably conveyed on a tubular string 130, such as a coiled tubing string, but it could also be conveyed by wireline or any other conveyance.

The tool 126 is inserted into the tubular structure 128 and seals 131 carried externally on the tool are positioned straddling a portion 132 of the tubular structure to be retracted. In the example depicted in FIGS. 11A&B, the portion 132 corresponds to a flow regulating portion 134 of a flow control device 136. Pressure is then applied to the tool 126, which causes a pressure decrease to be applied in the area between the seals 131.

The tool 126 includes a piston 138 reciprocably received within a generally tubular outer housing 140 of the tool. Openings 142 are formed through the piston 138 and provide fluid communication with an axial passage 144, which is in fluid communication with the interior of the tubing string 130. Openings 146 are formed through the housing 140, providing fluid communication with the exterior thereof.

When pressure is applied to the passage 144 via the tubing string 130, the differential between the pressure in the passage and the pressure external to the housing 140 causes the piston 138 to displace upwardly, thereby creating a pressure decrease in the area between the seals 131. This creates a pressure differential across the portion 132 of the tubular structure 128, causing the portion 132 to radially retract inwardly toward the tool 126. Thus, the piston 138 and associated bores of the housing 140 in which the piston is sealingly engaged are a pressure generator for producing a decreased pressure between the seals 131.

Figure 11B:
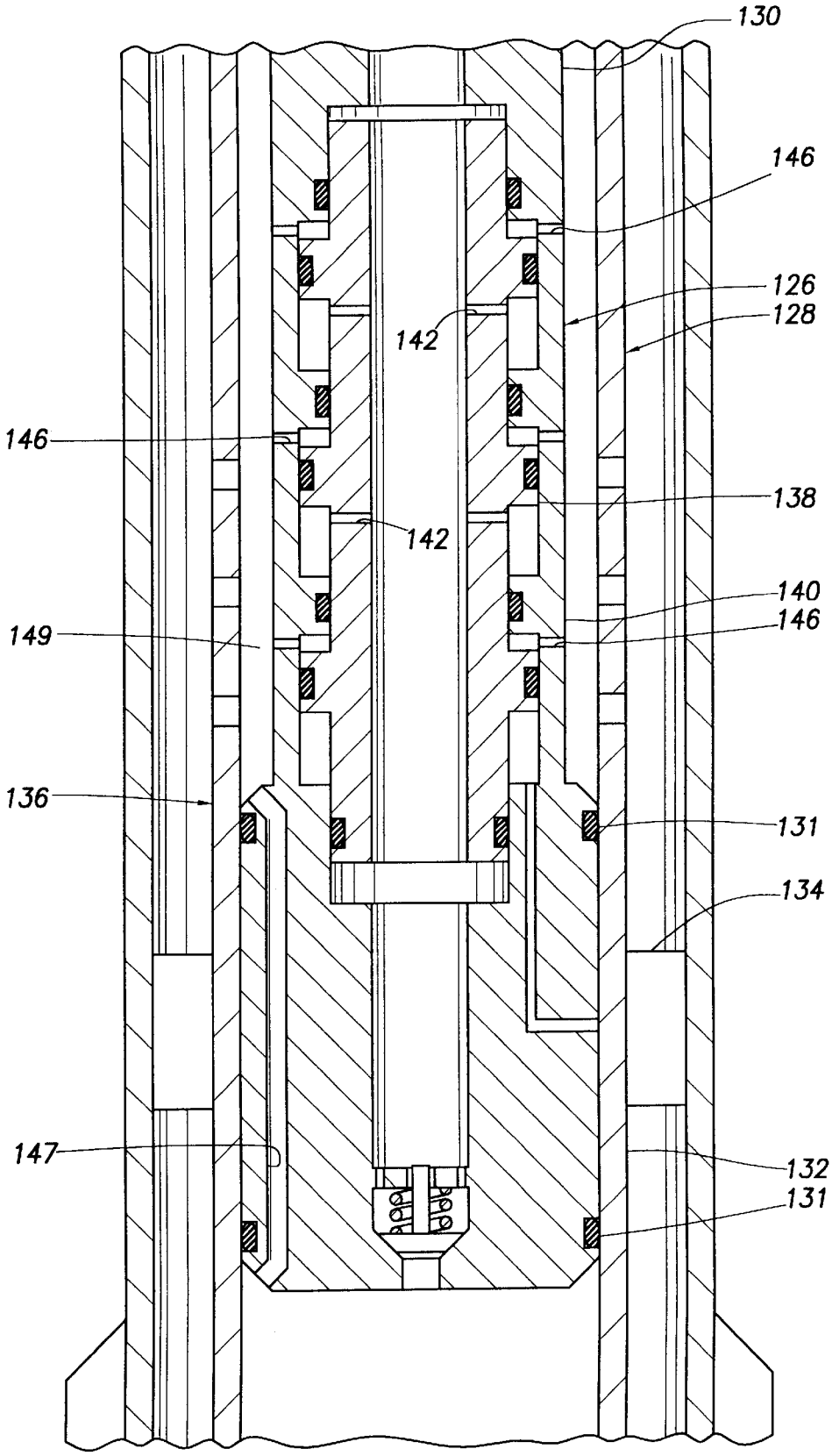

Referring specifically now to FIG. 11B, the tool 126 and tubular structure 128 are depicted after the portion 132 has been radially retracted. Note that the flow regulating portion 134 is decompressed as compared to that shown in FIG. 11A and, therefore, flow therethrough should be less restricted. A bypass passage 147 permits production of fluids from the well below the tool 126 during use of the tool, since the bypass passage interconnects the well below the tool with an annulus 149 formed between the tool and the tubular structure 128 above the seals 131.

Figure 12:
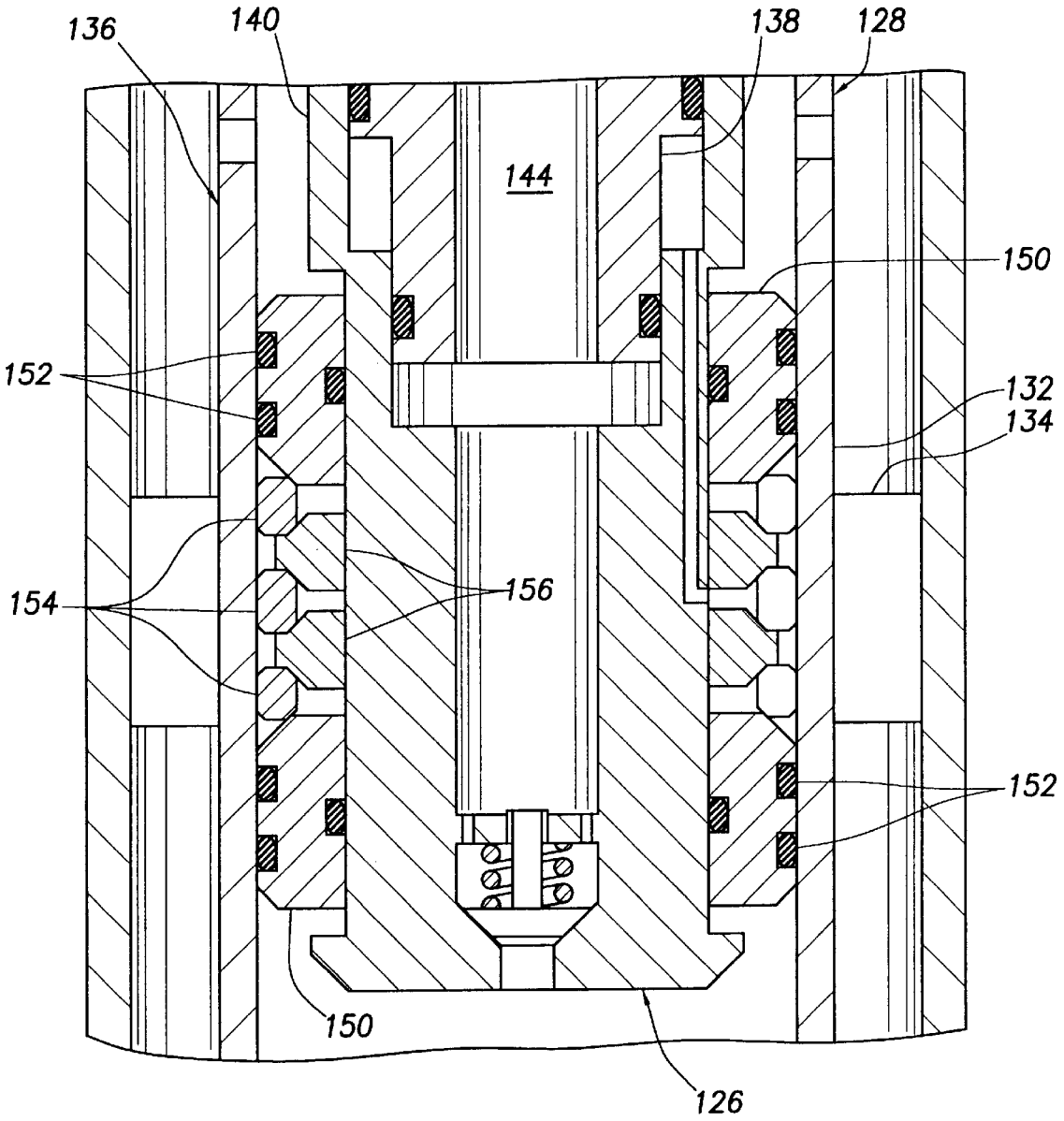
FIG. 12 is a schematic cross-sectional view of an alternate configuration of the tool of FIGS. 11A&B.

Referring additionally now to FIG. 12, an alternate configuration of the retraction tool 126 is representatively illustrated. Only a lower portion of the alternately configured retraction tool 126 is shown in FIG. 12, it being understood that the remainder of the tool is similar to that described above in relation to FIGS. 11A&B.

The alternately configured retraction tool 126 differs substantially from the retraction tool depicted in FIGS. 11A&B in that, instead of the seals 131, the retraction tool depicted in FIG. 12 includes two annular pistons 150 sealingly and reciprocably disposed on the housing 140. The pistons 150 have seals 152 carried externally thereon for sealing engagement straddling the portion 132 of the tubular structure 128 to be retracted.

Additionally, a series of annular stop members 154 are positioned between the pistons 150. Each of the stop members 154 is generally C-shaped, so that the stop members may be radially expanded as depicted in FIG. 12. When radially expanded, the stop members 154 are inherently biased radially inwardly, due to the resiliency of the material (e.g., steel) from which they are made.

The stop members 154 are radially expanded when the pistons 150 displace toward each other and the stop members are "squeezed" between the pistons and wedge members 156 positioned between the stop members. The pistons 150 and wedge members 156 have inclined surfaces formed thereon so that, when the pistons displace toward each other, the stop members 154 are radially expanded.

The pistons 150 are made to displace toward each other when the piston 138 displaces upwardly as described above, that is, when fluid pressure is applied to the passage 144. It will be readily appreciated that a reduced pressure in the area between the pistons 150 (due to upward displacement of the piston 138) will bias the pistons 150 toward each other. When fluid pressure is released from the passage 144, the pistons 150 are no longer biased toward each other, and the resiliency of the stop members 154 will bias the pistons 150 to displace away from each other, thereby permitting the stop members to radially retract.

As depicted in FIG. 12, the piston 138 has displaced upwardly, thereby creating a reduced pressure in the area between the pistons 150. The pistons 150 have displaced toward each other, and the portion 132 of the tubular structure 128 has radially retracted, in response to the reduced pressure. The stop members 154 have been radially expanded in response to the displacement of the pistons 150 and serve to prevent further radial retraction of the portion 132.

Thus, the stop members 154 are useful in limiting the radial retraction of the portion 132. For example, the stop members 154 may be dimensioned to prevent the portion 132 from being radially retracted to such an extent that it prevents retrieval of the tool 126, or the stop members 154 may be dimensioned to cause the portion 132 to radially retract to a certain position, so that the flow regulating portion 134 provides a desired restriction to flow therethrough.

Figure 13:
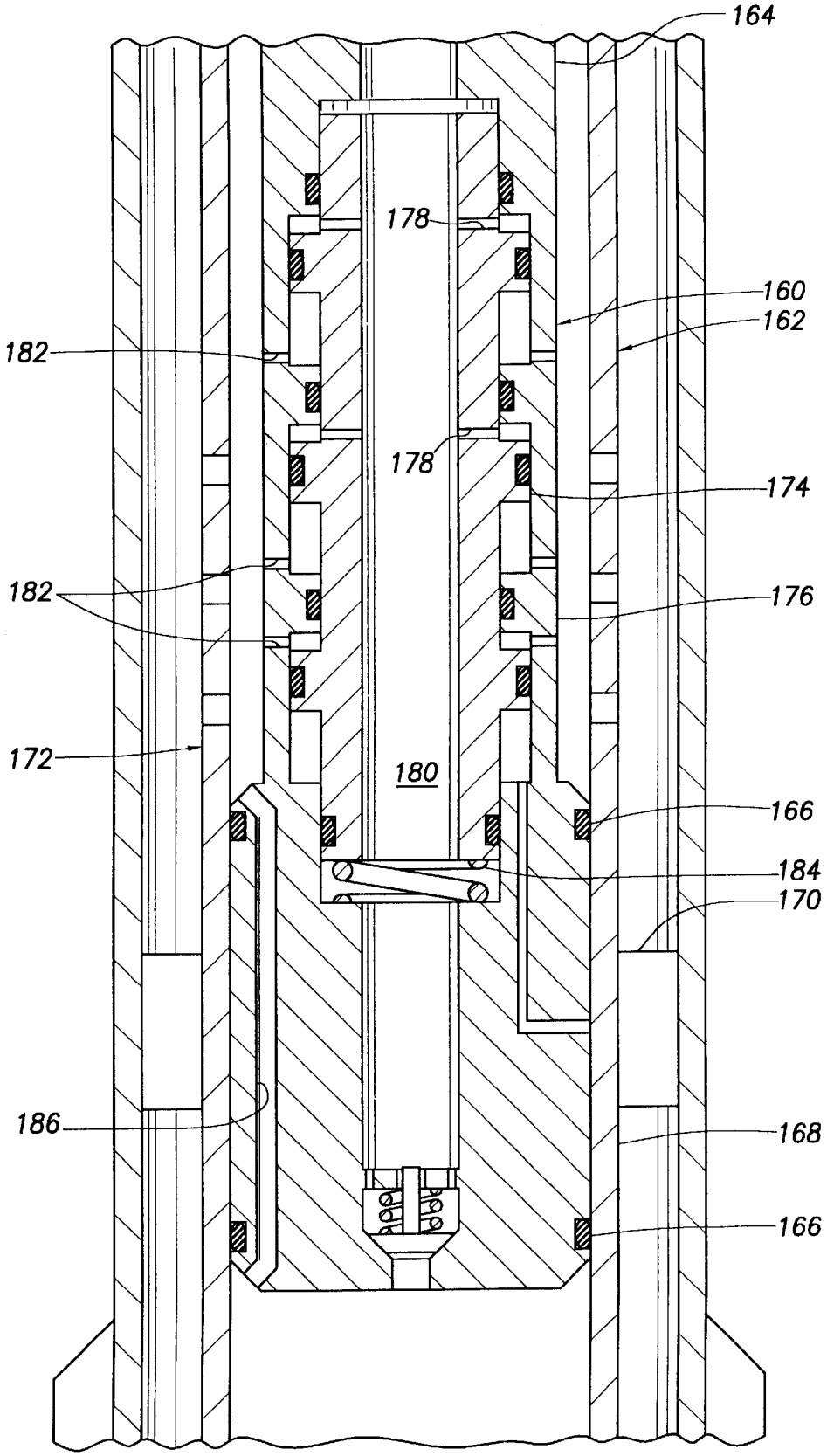
FIG. 13 is a schematic cross-sectional view of a tool for expanding a liner, the tool embodying principles of the present invention.

Referring additionally now to FIG. 13, a tool 160 used to radially extend portions of a tubular structure 162 is representatively illustrated. The tool 160 is preferably conveyed on a tubular string 164, such as a coiled tubing string, but it could also be conveyed by wireline or any other conveyance.

The tool 160 is inserted into the tubular structure 162 and seals 166 carried externally on the tool are positioned straddling a portion 168 of the tubular structure to be extended. In the example depicted in FIG. 13, the portion 168 corresponds to a flow regulating portion 170 of a flow control device 172. Pressure is then applied to the tool 160, which causes a pressure increase to be applied in the area between the seals 166.

The tool 160 includes a piston 174 reciprocably received within a generally tubular outer housing 176 of the tool. Openings 178 are formed through the piston 174 and provide fluid communication with an axial passage 180, which is in fluid communication with the interior of the tubing string 164. Openings 182 are formed through the housing 176, providing fluid communication with the exterior thereof.

When pressure is applied to the passage 180 via the tubing string 164, the differential between the pressure in the passage and the pressure external to the housing 176 causes the piston 174 to displace downwardly against an upwardly biasing force exerted by a spring or other bias member 184, thereby creating a pressure increase in the area between the seals 166. Due to multiple differential areas formed on the piston 174 and housing 176, the pressure between the seals 166 is greater than the pressure in the passage 180, although the use of multiple differential areas and a pressure between the seals greater than pressure in the passage is not necessary in keeping with the principles of the present invention. The piston 174 and the bores of the housing 176 in which the piston is sealingly received, thus, form a pressure generator for producing an increased pressure between the seals 166.

This pressure increase between the seals 166 creates a pressure differential across the portion 168 of the tubular structure 162, causing the portion 168 to radially extend outwardly away from the tool 160. Such outward extension of the portion 168 may be used to decrease a rate of fluid flow through the flow regulating portion 170.

When the fluid pressure is released from the passage 180, the spring 184 displaces the piston 174 upward, and the tool 160 is ready to radially extend another portion of the tubular structure 162, for example, to regulate flow through another flow control device, etc. Alternatively, fluid flow through the flow regulating portion 170 may be checked after the portion 168 is extended, for example, utilizing the seals 88, housing 90 and sensor 100 as described above for the tool 86 depicted in FIG. 6, and the portion 168 may be further extended by applying further fluid pressure to the passage 180, if needed to further reduce fluid flow through the flow regulating portion. A bypass passage 186 permits production of fluid from the well below the tool 160 during the use of the tool.

Figure 14:
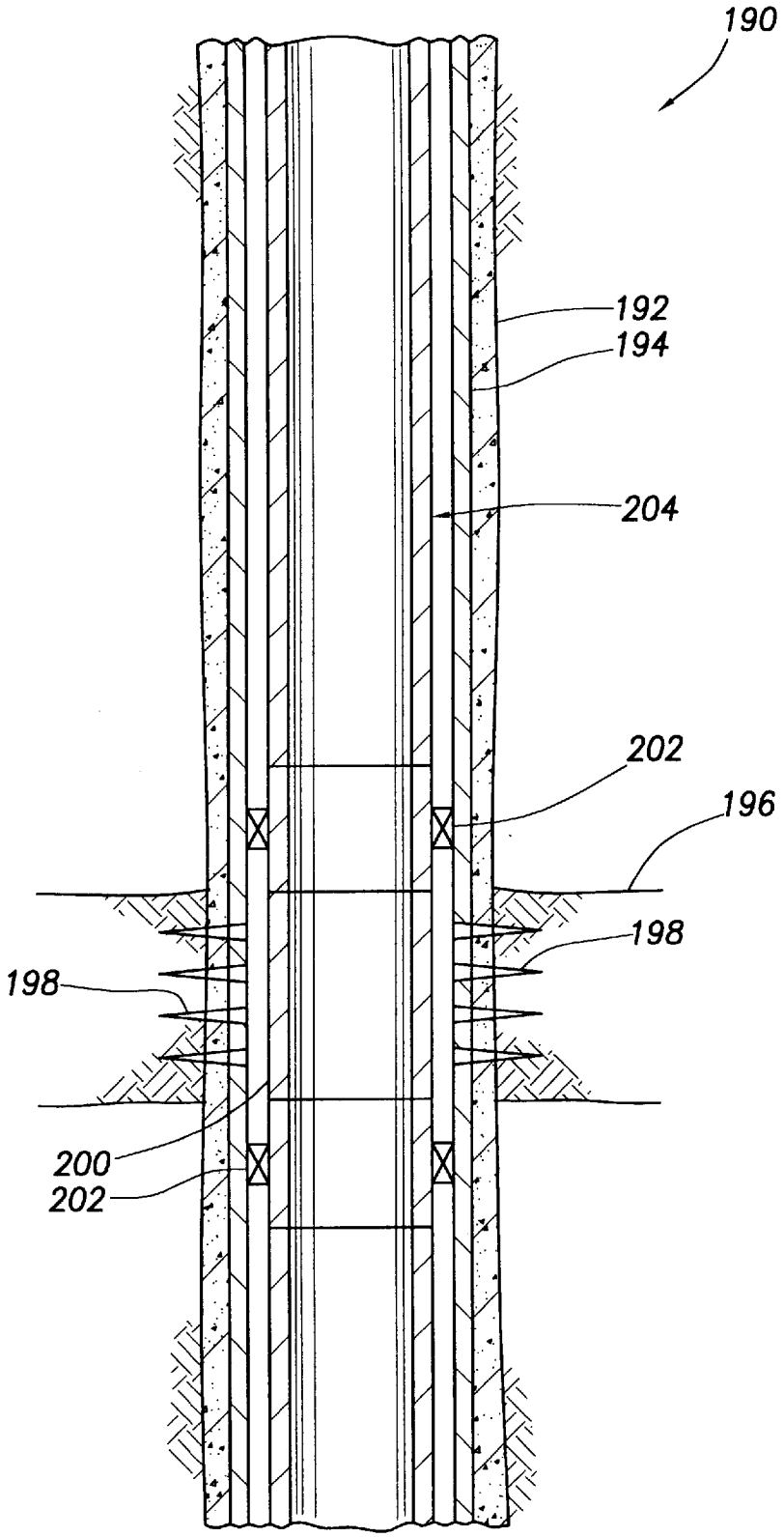
FIG. 14 is a schematic view of a method of regulating flow through casing, the method embodying principles of the present invention.

Referring additionally now to FIG. 14, another method 190 embodying principles of the present invention is representatively illustrated. The method 190 is similar in many respects to the method 10 described above. However, the method 190 is performed in a wellbore 192 lined with protective casing 194, and well screens are not utilized. Instead, fluid flow from a formation or zone 196 intersected by the wellbore 192 enters perforations 198 formed through the casing 194 and passes through a flow control device 200 interconnected between sealing devices 202 in a liner assembly 204. In the method 190, the perforations 198 are analogous to the inflow area (the openings 52) of the each of the well screens 14, 16, 18 in the method 10.

The sealing devices 202 may be similar to any of the sealing devices 28, 30, 32, 34, 38, 40, 42, 44, 68, 70 described above. The flow control device 200 may be similar to any of the flow control devices 46, 48, 50, 62, 110, 136, 172 described above.

In the method 190, the liner assembly 204 is conveyed into the wellbore 192 and positioned so that the sealing devices 202 straddle the perforations 198. The liner assembly 204 is expanded radially outward as described above for the liner assembly 36. Substantially all of the liner assembly 204 may be expanded, or only portions thereof (such as the sealing devices 202) may be expanded. For example, selected portions of the liner assembly 204 may be configured so that they are less resistant to extension thereof than other portions of the liner assembly, as described for the liner assembly 36 above in relation to FIG. 1E. Expansion of the liner assembly 204 causes the sealing devices 202 to sealingly engage the casing 194 on each side of the perforations 198.

The flow control device 200 may then be utilized to regulate a rate of fluid flow into the liner assembly 204. To regulate the fluid flow, a flow regulating portion of the flow control device 200 may be compressed between the liner assembly 204 and the casing 194 by radially outwardly expanding a portion of the flow control device, as described above for the flow regulating portions 76, 112, 134, 170. The tools 86, 126, 160 may be used with the liner assembly 204 to radially expand or retract portions of the liner assembly to increase or decrease fluid flow through the flow regulating portion of the flow control device 200.

Thus, the method 190 demonstrates that the principles of the present invention may be utilized in cased wellbores and in situations where a screen assembly is not utilized. In general, the liner assembly 204 is used to control fluid flow through the casing 194 in the method 190 in a manner similar to the way the liner assembly 36 is used to control fluid flow through the well screens 14, 16, 18 in the method 10.

It will now be fully appreciated that the present invention provides convenient, economical and functionally enhanced regulation of fluid flow downhole. Additionally, flow through well screens may be individually controlled and monitored using the principles of the present invention. This result is accomplished merely by expanding and retracting portions of a tubular structure with an associated flow regulating device.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of controlling fluid flow through a first tubular structure positioned in a well, the method comprising the steps of:

positioning a second tubular structure within the first tubular structure in the well; and deforming the second tubular structure, thereby altering a flowpath for flow of fluid through a first sidewall of the first tubular structure, the flowpath extending into the interior of the second tubular structure through at least one sidewall opening therein.

2. The method according to claim 1, wherein in the positioning step the second tubular structure is in a radially contracted configuration, and in the deforming step the second tubular structure is deformed to a radially enlarged configuration thereof.

3. The method according to claim 1, wherein the deforming step further comprises sealingly engaging the second tubular structure with the first tubular structure.

4. The method according to claim 3, wherein the deforming step further comprises radially extending the second tubular structure.

5. The method according to claim 4, wherein the extending step comprises contacting the first tubular structure with an outer sealing material of the second tubular structure.

6. The method according to claim 5, wherein the contacting step comprises decreasing a flow area disposed between adjacent portions of the sealing material.

7. The method according to claim 1, wherein the deforming step comprises changing a flow area of the flowpath disposed externally on the second tubular structure.

8. The method according to claim 1, wherein the first tubular structure comprises a well screen, and wherein the deforming step further comprises sealingly engaging the second tubular structure at opposite ends of the well screen.

9. The method according to claim 1, wherein the deforming step further comprises outwardly extending the second tubular structure.

10. The method according to claim 9, wherein the extending step further comprises extending only selected portions of the second tubular structure.

11. The method according to claim 10, wherein in the extending step, the selected portions are configured so that they are less resistant to extension thereof than unselected portions of the second tubular structure.

12. The method according to claim 1, wherein the deforming step further comprises altering a flow area disposed radially between the second tubular structure and the first tubular structure.

13. The method according to claim 1, wherein the second tubular structure includes a flow control device disposed between external seals, and wherein the extending step further comprises extending the seals into contact with the first tubular structure.

14. The method according to claim 1, wherein the flowpath is a tortuous path formed on the second tubular structure, and wherein the deforming step further comprises engaging the tortuous path with the first tubular structure.

15. The method according to claim 1, further comprising the steps of positioning a sensor within the second tubular structure after the deforming step and sensing a parameter of fluid flowing through the flowpath.

16. A method of controlling fluid flow through a first tubular structure positioned in a well, the method comprising the steps of:

positioning a second tubular structure within the first tubular structure in the well; and deforming the second tubular structure, thereby altering a flowpath for flow of fluid through a first sidewall of the first tubular structure, the deforming step comprising changing a flow area of the flowpath disposed externally on the second tubular structure, wherein in the changing step, a width of a longitudinal channel in fluid communication with an opening formed through a second sidewall of the second tubular structure is changed.

17. A method of controlling fluid flow through a first tubular structure positioned in a well, the method comprising the steps of:

positioning a second tubular structure within the first tubular structure in the well; and deforming the second tubular structure, thereby altering a flowpath for flow of fluid through a first sidewall of the first tubular structure, the deforming step comprising changing a flow area of the flowpath disposed externally on the second tubular structure, wherein in the changing step, a depth of a longitudinal channel in fluid communication with an opening formed through a second sidewall of the second tubular structure is changed.

18. A method of controlling fluid flow through a first tubular structure positioned in a well, the method comprising the steps of:

positioning a second tubular structure within the first tubular structure in the well; and deforming the second tubular structure, thereby altering a flowpath for flow of fluid through a first sidewall of the first tubular structure, the deforming step comprising changing a flow area of the flowpath disposed externally on the second tubular structure, wherein the flowpath includes at least one restriction of the flow area, and wherein the changing step further comprises changing a resistance to fluid flow through the restriction.

19. The method according to claim 18, wherein the restriction is formed externally on the second tubular structure.

20. The method according to claim 18, wherein the restriction is formed between portions of sealing material on the second tubular structure.

21. The method according to claim 18, wherein the restriction is formed in a channel formed externally on the second tubular structure.

22. A method of controlling fluid flow through a first tubular structure positioned in a well, the method comprising the steps of:

positioning a second tubular structure within the first tubular structure in the well; and deforming the second tubular structure, thereby altering a flowpath for flow of fluid through a first sidewall of the first tubular structure, the deforming step further comprising outwardly extending the second tubular structure, the extending step further comprising compressing a member within the second tubular structure.

23. A method of controlling fluid flow through a first tubular structure positioned in a well, the method comprising the steps of:

positioning a second tubular structure within the first tubular structure in the well; and deforming the second tubular structure, thereby altering a flowpath for flow of fluid through a first sidewall of the first tubular structure, the deforming step further comprising altering a flow area disposed radially between the second tubular structure and the first tubular structure, wherein in the deforming step the flow area is disposed axially between an opening formed through a sidewall of the second tubular structure and an inflow area of the first tubular structure.

24. A method of controlling fluid flow through multiple well screens of a screen assembly positioned in a wellbore, the method comprising the steps of:

positioning a tubular structure within the screen assembly; and deforming the tubular structure, thereby altering at least one flowpath for flow of fluid through at least one of the well screens, the flowpath extending into the interior of the tubular structure through at least one sidewall opening therein.

25. The method according to claim 24, wherein the deforming step further comprises altering multiple flowpaths for flow of fluid through corresponding respective ones of the well screens.

26. The method according to claim 24, wherein the deforming step further comprises altering first and second flowpaths for flow of fluid through first and second well screens.

27. The method according to claim 24, further comprising the step of sealingly engaging the screen assembly with the wellbore between adjacent ones of the well screens.

28. The method according to claim 24, wherein in the positioning step the tubular structure is in a radially contracted configuration, and in the deforming step the tubular structure is deformed to a radially enlarged configuration thereof.

29. The method according to claim 24, wherein the deforming step further comprises sealingly engaging the tubular structure with the screen assembly.

30. The method according to claim 29, wherein the deforming step further comprises radially extending the tubular structure.

31. The method according to claim 30, wherein the extending step comprises contacting the screen assembly with an outer sealing material of the tubular structure.

32. The method according to claim 31, wherein the contacting step comprises decreasing a flow area disposed between adjacent portions of the sealing material.

33. The method according to claim 24, wherein the deforming step comprises changing a flow area of the flowpath disposed externally on the tubular structure.

34. The method according to claim 24, wherein the deforming step further comprises sealingly engaging the tubular structure with the screen assembly straddling at least one of the well screens.

35. The method according to claim 24, wherein the deforming step further comprises outwardly extending the tubular structure.

36. The method according to claim 24, wherein the deforming step further comprises altering a flow area disposed radially between the tubular structure and the screen assembly.

37. The method according to claim 24, wherein the tubular structure includes a flow control device disposed between external seals, and wherein the extending step further comprises extending the seals into contact with the screen assembly.

38. A method of controlling fluid flow through multiple well screens of a screen assembly positioned in a wellbore, the method comprising the steps of:

positioning a tubular structure within the screen assembly; and deforming the tubular structure, thereby altering at least one flowpath for flow of fluid through at least one of the well screens, the deforming step further comprising altering first and second flowpaths for flow of fluid through first and second well screens, wherein in the altering step, the first flowpath is altered to restrict fluid flow therethrough differently from restriction to fluid flow through the second flowpath.

39. A method of controlling fluid flow through multiple well screens of a screen assembly positioned in a wellbore, the method comprising the steps of:

positioning a tubular structure within the screen assembly; and deforming the tubular structure, thereby altering at least one flowpath for flow of fluid through at least one of the well screens, the deforming step comprising changing a flow area of the flowpath disposed externally on the tubular structure, wherein in the changing step, a width of a longitudinal channel in fluid communication with an opening formed through a sidewall of the tubular structure is changed.

40. A method of controlling fluid flow through multiple well screens of a screen assembly positioned in a wellbore, the method comprising the steps of:

positioning a tubular structure within the screen assembly; and deforming the tubular structure, thereby altering at least one flowpath for flow of fluid through at least one of the well screens, the deforming step comprising changing a flow area of the flowpath disposed externally on the tubular structure, wherein in the changing step, a depth of a longitudinal channel in fluid communication with an opening formed through a sidewall of the tubular structure is changed.

41. A method of controlling fluid flow through multiple well screens of a screen assembly positioned in a wellbore, the method comprising the steps of:

positioning a tubular structure within the screen assembly; and deforming the tubular structure, thereby altering at least one flowpath for flow of fluid through at least one of the well screens, the deforming step comprising changing a flow area of the flowpath disposed externally on the tubular structure, wherein the flowpath includes at least one restriction of the flow area, and wherein the changing step further comprises changing a resistance to fluid flow through the restriction.

42. The method according to claim 41, wherein the restriction is formed externally on the tubular structure.

43. The method according to claim 41, wherein the restriction is formed between portions of sealing material on the tubular structure.

44. The method according to claim 41, wherein the restriction is formed in a channel formed externally on the tubular structure.

45. A method of controlling fluid flow through multiple well screens of a screen assembly positioned in a wellbore, the method comprising the steps of:

positioning a tubular structure within the screen assembly; and deforming the tubular structure, thereby altering at least one flowpath for flow of fluid through at least one of the well screens, the deforming step comprising outwardly extending the tubular structure, wherein the extending step further comprises compressing a member within the tubular structure.

46. A method of controlling fluid flow through multiple well screens of a screen assembly positioned in a wellbore, the method comprising the steps of:

positioning a tubular structure within the screen assembly; and deforming the tubular structure, thereby altering at least one flowpath for flow of fluid through at least one of the well screens, the deforming step comprising altering a flow area disposed radially between the tubular structure and the screen assembly, wherein in the deforming step, the flow area is disposed axially between an opening formed through a sidewall of the tubular structure and an inflow area of the screen assembly.

47. A method of controlling fluid flow through multiple well screens of a screen assembly positioned in a wellbore, the method comprising the steps of:

positioning a tubular structure within the screen assembly; and deforming the tubular structure, thereby altering at least one flowpath for flow of fluid through at least one of the well screens, wherein the flowpath is a tortuous path formed on the tubular structure, and wherein the deforming step further comprises engaging the tortuous path with the screen assembly.

48. A method of controlling fluid flow through multiple well screens of a screen assembly positioned in a wellbore, the method comprising the steps of:

positioning a tubular structure within the screen assembly;

deforming the tubular structure, thereby altering at least one flowpath for flow of fluid through at least one of the well screens;

positioning a sensor within the tubular structure after the deforming step; and sensing a parameter of fluid flowing through the flowpath.

49. A method of controlling fluid flow through multiple well screens of a screen assembly positioned in a wellbore, the method comprising the steps of:

positioning a tubular structure within the screen assembly;

deforming the tubular structure, thereby altering at least one flowpath for flow of fluid through at least one of the well screens; and outwardly deforming the screen assembly, so that the well screens contact the wellbore.

50. The method according to claim 49, wherein the step of outwardly deforming the screen assembly is performed prior to the step of positioning the tubular structure within the screen assembly.

51. A system for controlling fluid flow in a wellbore, the system comprising:

a well screen in the wellbore; and a tubular structure received in the well screen, the tubular structure being deformed after reception within the well screen, thereby altering a flowpath for flow of fluid through the well screen, the flowpath extending into the interior of the tubular structure through at least one sidewall opening therein.

52. The system according to claim 51, wherein the tubular structure includes a flow control device disposed between external seals, the seals being sealingly engaged straddling the well screen.

53. The system according to claim 51, wherein the deformed tubular structure alters a flow area disposed radially between the tubular structure and the well screen.

54. The system according to claim 51, wherein the tubular structure is deformed so that it is outwardly extended relative to a configuration of the tubular structure prior to its reception within the well screen.

55. The system according to claim 54, wherein the tubular structure includes selected portions thereof which are less resistant to outward extension thereof than unselected portions of the tubular structure.

56. The system according to claim 55, wherein the selected tubular structure portions straddle the well screen.

57. The system according to claim 55, wherein the selected portions are sealingly engaged straddling the well screen, thereby constraining fluid flow through the well screen to also flow through the tubular structure.

58. The system according to claim 51, wherein a flow area disposed radially between the tubular structure and the well screen is altered by deformation of the tubular structure after reception within the well screen.

59. The system according to claim 51, wherein the tubular structure includes at least one selected portion thereof which is less resistant to radial displacement than unselected portions of the tubular structure.

60. The system according to claim 51, wherein the flowpath is disposed externally on the tubular structure.

61. A system for controlling fluid flow in a wellbore, the system comprising:

a well screen in the wellbore;

a tubular structure received in the well screen, the tubular structure being deformed after reception within the well screen, thereby altering a flowpath for flow of fluid through the well screen; and a sensor positioned within the tubular structure, the sensor sensing a parameter of fluid flowing through the flowpath.

62. A system for controlling fluid flow in a wellbore, the system comprising:

a well screen in the wellbore; and a tubular structure received in the well screen, the tubular structure being deformed after reception within the well screen, thereby altering a flowpath for flow of fluid through the well screen, wherein the flowpath is a tortuous path formed on the tubular structure, and wherein the tortuous path is engaged with the well screen.

63. A system for controlling fluid flow in a wellbore, the system comprising:

a well screen in the wellbore; and a tubular structure received in the well screen, the tubular structure being deformed after reception within the well screen, thereby altering a flowpath for flow of fluid through the well screen, the deformed tubular structure altering a flow area disposed radially between the tubular structure and the well screen, wherein the flow area is disposed axially between an opening formed through a sidewall of the tubular structure and an inflow area of the well screen.

64. A system for controlling fluid flow in a wellbore, the system comprising:

a well screen in the wellbore; and a tubular structure received in the well screen, the tubular structure being deformed after reception within the well screen, thereby altering a flowpath for flow of fluid through the well screen, the tubular structure including at least one selected portion thereof which is less resistant to radial displacement than unselected portions of the tubular structure, the flowpath extending across the selected tubular structure portion.

65. The system according to claim 64, wherein an area of the flowpath is decreased by radial extension of the selected tubular structure portion.

66. A system for controlling fluid flow in a wellbore, the system comprising:

a well screen in the wellbore; and a tubular structure received in the well screen, the tubular structure being deformed after reception within the well screen, thereby altering a flowpath for flow of fluid through the well screen, wherein the flowpath is disposed at least partially in an external sealing material of the tubular structure.

67. The system according to claim 66, wherein the flowpath is disposed between portions of the sealing material.

68. The system according to claim 66, wherein the flowpath is disposed at least partially in a channel formed in the sealing material, the channel being in fluid communication with an opening formed through a sidewall of the tubular structure.

69. A method of controlling fluid flow through a first tubular structure positioned in a well, the method comprising the steps of:

installing a line externally on a second tubular structure having a sealing material carried externally thereon, the line extending across the sealing material, positioning the second tubular structure within the first tubular structure in the well; and sealingly engaging the sealing material with the first tubular structure, wherein in the installing step, the sealing material is part of a flow regulating portion of the second tubular structure, the sealing material having deformable flow channels formed thereon for adjusting a flow area therethrough.

70. The method according to claim 69, wherein the installing step further comprises installing the line in an external channel positioned between adjacent ones of the flow channels.

* * * * *